US008183969B2

(12) United States Patent
Kudo et al.

(10) Patent No.: US 8,183,969 B2
(45) Date of Patent: May 22, 2012

(54) COIL COMPONENT

(75) Inventors: Takashi Kudo, Tokyo (JP); Hitoshi Ohkubo, Tokyo (JP); Masatoshi Shindoh, Tokyo (JP)

(73) Assignee: TDK Corporation, Tokyo (JP)

( * ) Notice: Subject to any disclaimer, the term of this patent is extended or adjusted under 35 U.S.C. 154(b) by 85 days.

(21) Appl. No.: 12/772,514

(22) Filed: May 3, 2010

(65) Prior Publication Data

US 2010/0321144 A1 Dec. 23, 2010

(30) Foreign Application Priority Data

Jun. 17, 2009 (JP) ..... 2009-144113

(51) Int. Cl.
*H01F 5/00* (2006.01)

(52) U.S. Cl. ..... 336/200

(58) Field of Classification Search ..... 336/65, 336/83, 200, 205–208, 210, 232, 219, 233
See application file for complete search history.

(56) References Cited

U.S. PATENT DOCUMENTS

| | | | | |
|---|---|---|---|---|
| 5,530,416 | A | 6/1996 | Wakamatsu et al. | |
| 6,014,068 | A * | 1/2000 | Nobutoki et al. | 335/78 |
| 6,535,094 | B2 * | 3/2003 | Murata et al. | 336/83 |
| 6,649,524 | B2 | 11/2003 | Watanabe | |
| 2008/0252406 | A1 | 10/2008 | Kitajima et al. | |

FOREIGN PATENT DOCUMENTS

| | | |
|---|---|---|
| JP | A-03-242907 | 10/1991 |
| JP | A-05-047563 | 2/1993 |
| JP | A-5-347207 | 12/1993 |
| JP | A-07-161530 | 6/1995 |
| JP | B2-3116696 | 10/2000 |
| JP | A-2001-44069 | 2/2001 |
| JP | A-2001-237135 | 8/2001 |
| JP | A-2003-068530 | 3/2003 |
| JP | A-2003-257725 | 9/2003 |
| JP | B2-3620404 | 11/2004 |
| JP | A-2008-262984 | 10/2008 |

* cited by examiner

*Primary Examiner* — Tuyen Nguyen
(74) *Attorney, Agent, or Firm* — Oliff & Berridge, PLC

(57) ABSTRACT

A coil component which can secure the insulation and strength of a ferrite core and reserve a winding region sufficiently is provided. By coating a surface of an Mn—Zn-based ferrite core with a glass film, this coil component can secure the insulation between the ferrite core and a terminal electrode. Coating with the glass film also ensures the strength of the ferrite core, thereby inhibiting cracks from occurring in boundary parts between a winding core part and flanges. In the coil component, at least one of the thickness of the glass film covering the surface of the winding core part and the thickness of the glass film covering the inner side face of the flange is smaller than the thickness of the glass film in the remaining part. Thus suppressing the thickness of the glass film on the surface of the winding core part and on the inner side face of the flange can sufficiently secure a winding region M.

4 Claims, 4 Drawing Sheets

*Fig.4*

| Sample No. | Winding core part surface | Flange inner side face | Flange periphery | Flange outer side face |
|---|---|---|---|---|
| 1 | 3.33 | 4.99 | 10.27 | 11.46 |
| 2 | 2.67 | 3.09 | 8.79 | 10.09 |
| 3 | 3.15 | 3.21 | 10.34 | 13.48 |
| 4 | 1.96 | 1.90 | 8.68 | 12.30 |
| 5 | 1.61 | 1.13 | 8.26 | 13.01 |
| Ave. | 2.54 | 2.86 | 9.27 | 12.07 |

unit: $\mu$m

COIL COMPONENT

BACKGROUND OF THE INVENTION

1. Field of the Invention

The present invention relates to a winding type coil component.

2. Related Background Art

Known as a winding type coil component is one comprising a drum-shaped core having a winding core part and a pair of flanges arranged on both ends thereof and a wire wound about the winding core part. While Ni—Zn-based ferrite cores have conventionally been used for the drum-shaped core, Mn—Zn-based ferrite cores have come into use in order to secure magnetic characteristics as coil components have been reducing their sizes. The Mn—Zn-based ferrite cores incur less core loss and thus can suppress the power consumption.

The Mn—Zn-based ferrite cores have characteristics better than those of the conventional Ni—Zn-based ferrite cores but are electrically conductive, which makes it necessary to apply an insulating coating to their surface when forming electrodes thereon. On a ferrite core surface in the coil component described in Japanese Patent Publication No. 3116696, for example, the part coming into contact with soldering flux is covered with a glass film.

In the method of manufacturing an electronic component described in Japanese Patent Publication No. 3620404, for example, while a barrel containing ferrite cores is rotated, a glass slurry constituted by a glass powder, a binder resin, and a solvent is sprayed over the ferrite cores, so as to form uniform glass films on their surfaces. Such coating with the glass films also contributes to securing the core strength.

SUMMARY OF THE INVENTION

As mentioned above, covering the surface of an Mn—Zn-based ferrite core with a glass film is meaningful from the viewpoint of securing the insulation and core strength. When covering the surface of a core with a glass film, however, the insulation and core strength will be hard to secure if the film thickness is insufficient, whereas a region for winding the wire (winding region) will decrease if the film thickness is too large, whereby it is necessary to adjust the film thickness.

For overcoming the problems mentioned above, it is an object of the present invention to provide a coil component which can secure the insulation and strength of a ferrite core and reserve a winding region sufficiently.

For achieving the above-mentioned object, the present invention provides a coil component comprising an Mn—Zn-based ferrite core having a winding core part and a pair of flanges arranged at both ends of the winding core part, a wire wound about the winding core part, and a terminal electrode provided with the Mn—Zn-based ferrite core and connected to an end part of the wire; wherein the Mn—Zn-based ferrite core has a surface coated with a glass film; and wherein at least one of a thickness of the glass film covering a surface of the winding core part and a thickness of the glass film covering an inner side face of the flange is smaller than a thickness of the glass film in the remaining part.

By coating the surface of the Mn—Zn-based ferrite core with the glass film, the coil component can secure the insulation between the core and the terminal electrode. Coating with the glass film also ensures the strength of the Mn—Zn-based ferrite core, thereby inhibiting cracks from occurring in boundary parts between the winding core part and the flanges, for example. In the coil component, at least one of the thickness of the glass film covering the surface of the winding core part and the thickness of the glass film covering the inner side face of the flange is smaller than the thickness of the glass film in the remaining part. Suppressing the thickness of the glass film on the surface of the winding core part and on the inner side face of the flange can reserve the winding region, while keeping the thickness in the remaining part can secure the above-mentioned insulation and strength.

Preferably, the thickness of the glass film covering the surface of the winding core part is smaller than the thickness of the glass film covering the inner side face of the flange. This can reserve the winding region more.

Preferably, the winding core part has a density higher than that of the flange. When forming an Mn—Zn-based ferrite core by press-molding a ferrite powder, for example, a density difference occurs between the winding core part and the flange in general, whereby the winding core part has a density higher than that of the flange. In this case, the part yielding the density difference, i.e., the boundary part between the winding core part and the flange, becomes the most fragile part. However, the outer side face of the flange is covered with a glass film having a sufficient thickness, whereby cracks can be inhibited from occurring.

The present invention can secure the insulation and strength of a ferrite core and reserve a winding region sufficiently.

BRIEF DESCRIPTION OF THE DRAWINGS

FIG. 4 is a table listing examples of produced glass films.

DESCRIPTION OF THE PREFERRED EMBODIMENTS

In the following, preferred embodiments of the coil component in accordance with the present invention will be explained in detail with reference to the drawings.

Figure 1:
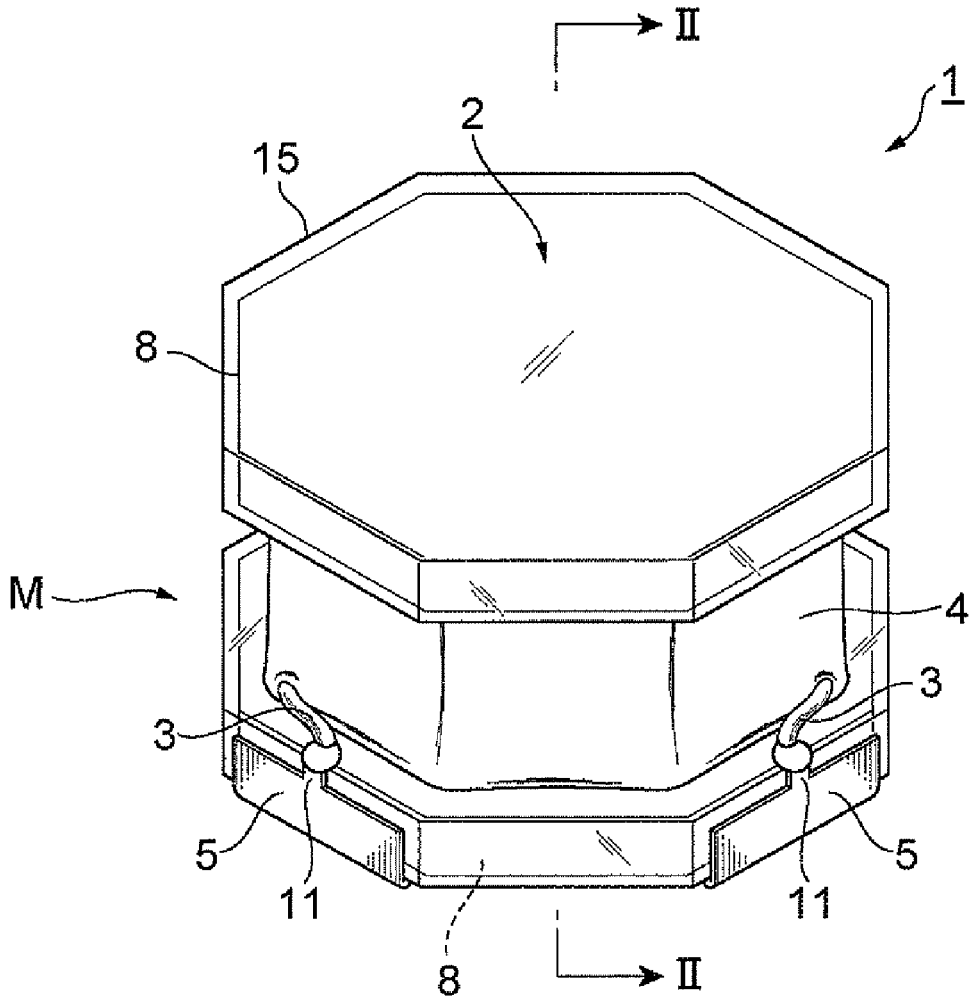
FIG. 1 is a perspective view illustrating an embodiment of the coil component in accordance with the present invention.
Figure 2:
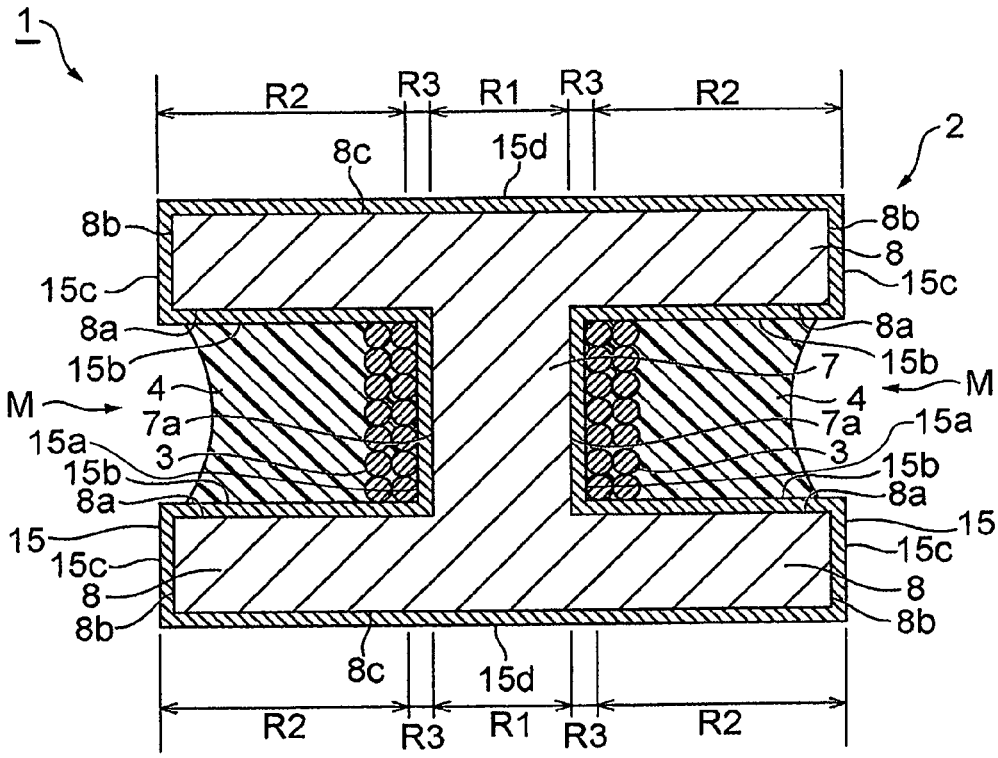
FIG. 2 is a sectional view taken along the line II-II of FIG. 1.

FIG. 1 is a perspective view illustrating an embodiment of the coil component in accordance with the present invention. FIG. 2 is a sectional view taken along the line II-II of FIG. 1. As illustrated in FIGS. 1 and 2, this coil component 1 comprises a drum-shaped ferrite core 2, a wire 3, a coating 4, and a pair of terminal electrodes 5, 5.

As illustrated in FIG. 2, the ferrite core 2 has a columnar winding core part 7 about which the wire 3 is wound and a pair of flanges 8, 8 which are respectively formed at both longitudinal ends of the winding core part 7. The winding core part 7 has a cross section shaped like a square whose sides are about 1 mm each, for example, and a length of about 0.3 to 1.8 mm, for example. The ferrite core 2 is shaped when a mold filled with an Mn—Zn-based ferrite powder is pressed inward from outside the peripheries of the winding core part 7, for example.

The flanges 8, 8, each of which is octagonal in a planar view, for example, protrude radially of the winding core part 7 in a substantially parallel state. Each of the flanges 8, 8 has a width of about 1.5 to 4.0 mm, for example, in a side view. Each of the flanges 8, 8 has a thickness of about 0.1 to 0.5 mm, for example.

In thus constructed ferrite core 2, a region defined by the surface 7*a* of the winding core part 7 and inner side faces 8*a* of the flanges 8 is a winding region M for winding the wire 3. The wire 3 is one having a diameter of about 0.1 mm, for example. Copper is used for a metal conductor of the wire 3, for example, while urethane is used for its coating, for example. The wire 3 is wound about the outer peripheral portion of the winding core part 7 in the winding region M.

The coating 4 is arranged in the winding region M so as to cover the wire 3 wound about the winding core part 7. The outer periphery of the coating 4 is positioned in line with or on the inside (the winding core part 7 side) of the peripheries 8*b* of the flanges 8, 8. The coating 4 is formed by drying and curing a coating material which is a mixture of a resin powder, an inorganic powder, and a solvent, for example.

One flange 8 is provided with the pair of terminal electrodes 5, 5. One terminal electrode 5 is formed over an area on one side of the main face of the flange 8 and the periphery 8*b* joined thereto. While being separated from this terminal electrode 5, the other terminal electrode 5 is formed over an area on the other side of the main face of the flange 8 and the periphery 8*b* joined thereto. The terminal electrodes 5, 5 are firmly secured to the flange 8 by bonding, crimping, or the like.

One end of the wire 3 is connected to one terminal electrode 5, while the other end of the wire 3 is connected to the other terminal electrode 5. The end parts of the wire 3 are tied about their corresponding relay parts 11, 11 of the electrodes 5, 5 and, while in this state, secured thereto by laser welding, arc welding, or the like. In the coil component 1, the main face of the flange 8 provided with the terminal electrodes 5, 5 serves as a surface which opposes a mounting surface of an external substrate or the like. The ferrite core 2 having silver burned thereto may be plated with nickel and tin, so as to form the terminal electrodes 5, 5, and the end parts of the wire 3 may be secured to the relay parts 11, 11 by thermocompression bonding.

The ferrite core 2 will now be explained in further detail. As mentioned above, the ferrite core 2 is formed by an Mn—Zn-based ferrite. Therefore, the ferrite core 2 is electrically conductive, which makes it necessary to secure insulation against the terminal electrodes 5, formed on the flange 8.

The ferrite core 2 is shaped when a mold filled with an Mn—Zn-based ferrite powder is pressed inward from outside the peripheries of the winding core part 7, whereby the wiring core part 7 and the flanges 8, 8 are formed at once. In thus molded ferrite core 2, however, a density difference occurs between a center part R1 including the winding core part 7 and its outside part R2, whereby the center part R1 has a density higher than that of the outside part R2. In this case, the part yielding the density difference, i.e., a boundary part R3 between the center part R1 and outside part R2 (see FIG. 2), becomes the most fragile part.

Therefore, in the coil component 1, the surface of the ferrite core 2 is coated with a glass film 15 as illustrated in FIGS. 1 and 2. The glass film 15 secures the insulation between the ferrite core 2 and the terminal electrodes 5, 5. It also ensures the strength of the ferrite 2, thereby inhibiting cracks from occurring in the boundary part R3 yielding the density difference.

When covering the surface of the ferrite core 2 with the glass film 15, on the other hand, the insulation and core strength will be hard to secure if the film thickness is insufficient, whereas the winding region M will decrease if the film thickness is too large. Therefore, when forming the glass film 15, it is necessary to adjust the film thickness for reserving the winding region M while securing the insulation and strength.

Figure 3:
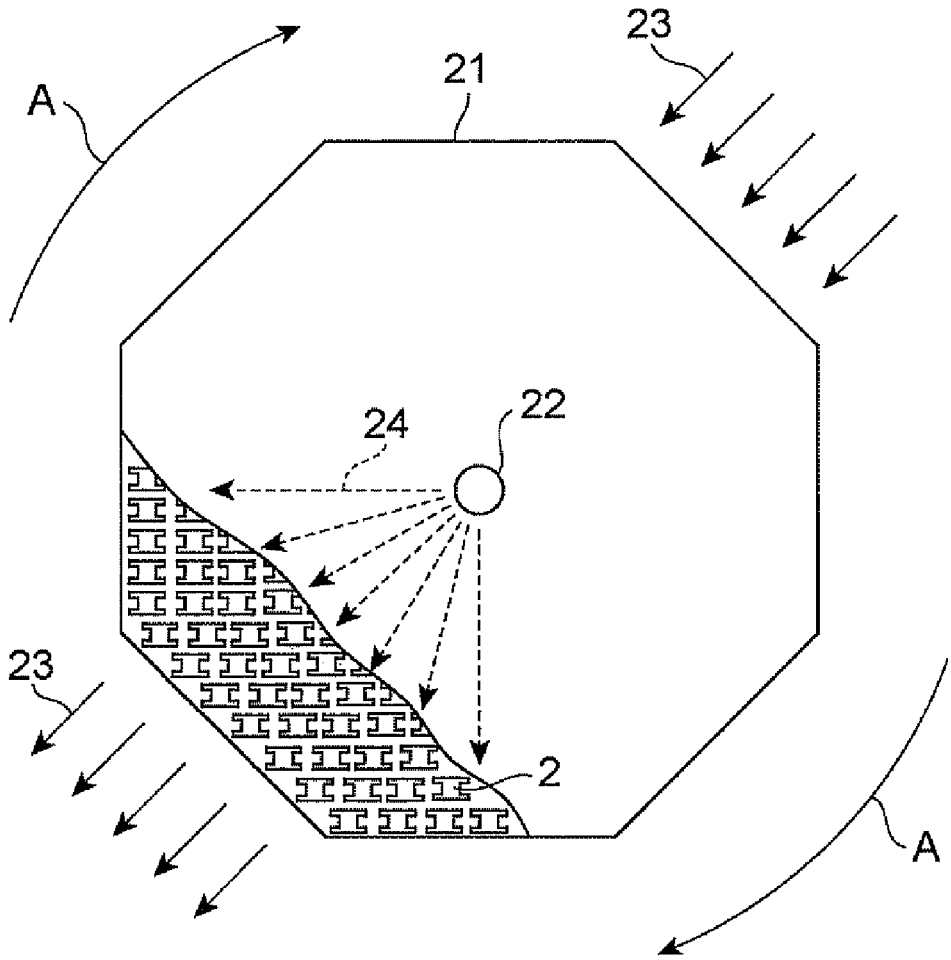
FIG. 3 is a schematic view illustrating how a glass film is formed.

FIG. 3 is a schematic view illustrating how the glass film 15 is formed. As illustrated in this drawing, a coating apparatus used for forming the glass film 15 has a barrel 21 formed by a stainless mesh. A baffle (not depicted) for randomly rotating works or the like is arranged within the barrel 21. A spray nozzle 22 is placed at the center part of the barrel 21.

For forming the glass film 15, one lot of press-molded ferrite cores 2 is accommodated in the barrel 21 at first. Subsequently, while the barrel 12 is rotated in the direction of arrow A, a glass slurry 24 which is a mixture of a glass powder, a binder such as polyvinylalcohol, and a solvent is jetted out like a mist from the spray nozzle 22, while a drying air 23 is sprayed to the barrel 21.

The rotating speed of the barrel 21 is about 0.5 to 5.0 rpm, for example. The glass slurry 24 has a mist size of about 5.0 to 20 μm, for example. The temperature of the drying air is 70° C., for example. After being dried, the ferrite core 2 is taken out of the barrel 21 and fired for a predetermined time at about 700° C., for example. This softens the glass powder, thereby forming the transparent glass film 15 on the surface of the ferrite core 2.

Thus formed glass film 15 varies its thickness among different parts of the ferrite core 2, so that at least one of a part 15*a* covering the surface 7*a* of the winding core part 7 and a part 15*b* covering the inner side face 8*a* of the flange 8 is thinner than the remaining part. More preferably, the thickness of the glass film 15 is the smallest in the part 15*a* covering the surface 7*a* of the winding core part 7 and increases in the order of the part 15*b* covering the inner side face 8*a* of the flange 8, a part 15*c* covering the periphery 8*b* of the flange 8, and a part 15*d* covering an outer side face 8*c* of the flange 8.

Preferably, the spray nozzle 22 in the coating apparatus can freely change its direction. When the direction of the spray nozzle 22 is shifted from the plane of rotation of the barrel 21 such that the leading end of the spray nozzle 22 does not oppose the ferrite core 2 within the barrel 21 at right angles, the glass slurry is harder to enter the winding region M of the ferrite core 2, whereby the above-mentioned thickness difference in the glass film 15 can be formed more reliably.

FIG. 4 is a table listing examples of produced glass films. In the examples listed in the table, samples (Nos. 1 to 5) of the ferrite core 2 were produced, and the thickness of their glass films 15 formed under the conditions mentioned above was measured on each of the winding core part surface, flange inner side face, flange periphery, and flange outer side face. Each part of Sample Nos. 1 to 5 had a size falling within the same range as that in the above-mentioned embodiment.

It can be seen from the results listed in FIG. 4 that each of the thickness of the part 15*a* covering the surface 7*a* of the winding core part 7 and the thickness of the part 15*b* covering the inner side face 8*a* of the flange 8 is smaller than each of the thickness of the part 15*c* covering the periphery 8*b* of the flange 8 and the part 15*d* covering the outer side face 8*c* of the flange 8 in all the samples.

The thickness of the part 15*a* covering the surface 7*a* of the winding core part 7 is smaller than the thickness of the part 15*b* covering the inner side face 8*a* of the flange 8 in Sample Nos. 1 to 3, but larger than the latter in Sample Nos. 4 and 5.

As explained in the foregoing, the coil component 1 can secure the insulation between the ferrite core 2 and the terminal electrodes 5, 5 by coating the surface of the Mn—Zn-based ferrite core 2 with the glass film 15. Coating with the glass film 15 also ensures the strength of the ferrite core 2, thereby inhibiting cracks from occurring in the boundary parts between the winding core part 7 and the flanges 8.

In the coil component 1, at least one of the thickness of the glass film 15 covering the surface 7*a* of the winding core part 7 and the thickness of the glass film 15 covering the inner side face 8*a* of the flange 8 is smaller than the thickness of the glass film 15 in the remaining part. Thus suppressing the thickness of the glass film 15 on the surface 7*a* of the winding core part 7 and on the inner side face 8*a* of the flange 8 can sufficiently secure the winding region M.

In particular, in the coil component 1, the ferrite core 2 is formed by press-molding the Mn—Zn ferrite powder, so that the density of the winding core part 7 is higher than that of the flange 8. Therefore, the boundary part R3 between the center part R1 including the winding core part 7 and its outside part R2 becomes the most fragile part. However, the glass film 15 is the thickest on the outer side face 8*c* of the flange 8, whereby cracks can effectively be inhibited from occurring.

It is sufficient for the film thicknesses in the individual parts to be compared with each other in terms of their average values, for example. The thickness of the part 15*a* covering the surface 7*a* of the winding core part 7 tends to taper down from the center of the winding core part to the flanges 8, while the thickness of the part 15*b* covering the inner side face 8*a* of the flange 8 tends to taper down from the outer side to the inner side. Therefore, the thickness of the glass film 15 becomes the smallest at corners of the winding region M where the surface 7*a* of the winding core part 7 and the inner side face 8*a* of the flange 8 meet.

The relationship between the thickness of the part 15*a* covering the surface 7*a* of the winding core part 7 and the thickness of the part 15*b* covering the inner side face 8*a* of the flange 8 may be reversed at the above-mentioned corners, but will not affect the effect of sufficiently securing the winding region M. Similarly, the relationship between the thickness of the part 15*b* covering the inner side face 8*a* of the flange 8 and the thickness of the part 15*c* covering the periphery 8*b* of the flange 8 may be reversed at edges of the flange 8 where the inner side face 8*a* of the flange 8 and the periphery 8*b* of the flange 8 meet, but will not affect the effect of sufficiently reserving the winding region M.

What is claimed is:

1. A coil component comprising:

an Mn—Zn-based ferrite core having a winding core part and a pair of flanges arranged at both ends of the winding core part;

a wire wound about the winding core part; and a terminal electrode provided with the Mn—Zn-based ferrite core and connected to an end part of the wire, wherein the Mn—Zn-based ferrite core has a surface coated with a glass film;

a thickness of the glass film is greatest in a portion that covers an outer side face of the flange; and a thickness of the glass film covering a surface of the winding core part and a thickness of the glass film covering an inner side face of the flange are smaller than a thickness of the glass film covering a periphery of the flange.

2. A coil component according to claim 1, wherein the thickness of the glass film covering the surface of the winding core part is smaller than the thickness of the glass film covering the inner side face of the flange.

3. A coil component according to claim 1, wherein the winding core part has a mass density higher than that of the flange.

4. A coil component comprising:

an Mn—Zn-based ferrite core having a winding core part and a pair of flanges arranged at both ends of the winding core part;

a wire wound about the winding core part; and a terminal electrode provided with the Mn—Zn-based ferrite core and connected to an end part of the wire, wherein the Mn—Zn-based ferrite core has a surface coated with a glass film; and a thickness of the glass film covering an inner side face of the flange tapers down from an outer side of the flange to an inner side of the flange, which is near the winding core part.

* * * * *